US006979006B2

(12) United States Patent
Pierron

(10) Patent No.: US 6,979,006 B2
(45) Date of Patent: Dec. 27, 2005

(54) UNDERFRAME WITH CONTROLLED DEFORMATION FOR GLIDING CRAFT, IN PARTICULAR FOR SKATEBOARD

(76) Inventor: Patrick Pierron, 7 Impasse Grammont, F-64200 Biarritz (FR)

( * ) Notice: Subject to any disclaimer, the term of this patent is extended or adjusted under 35 U.S.C. 154(b) by 0 days.

(21) Appl. No.: 10/476,001

(22) PCT Filed: Apr. 26, 2002

(86) PCT No.: PCT/FR02/01461

§ 371 (c)(1),
(2), (4) Date: Apr. 5, 2004

(87) PCT Pub. No.: WO02/087711

PCT Pub. Date: Nov. 7, 2002

(65) Prior Publication Data

US 2004/0155420 A1 Aug. 12, 2004

(30) Foreign Application Priority Data

Apr. 27, 2001 (FR) ..... 01 05720

(51) Int. Cl.[7] ..... B62M 1/00

(52) U.S. Cl. ..... 280/87.042

(58) Field of Search ..... 280/87.042, 87.041, 280/87.05, 87.043, 87.021, 87.01, 14.21, 280/610

(56) References Cited

U.S. PATENT DOCUMENTS

| | | | | |
|---|---|---|---|---|
| 4,076,267 | A | 2/1978 | Lipscomb | |
| 4,082,306 | A | 4/1978 | Sheldon | |
| 4,353,566 | A * | 10/1982 | Mohlenbrock | 280/87.042 |
| 4,458,907 | A * | 7/1984 | Meredith | 280/87.042 |
| D338,253 | S * | 8/1993 | Smith et al. | D21/765 |
| 5,417,444 | A * | 5/1995 | Chen | 280/87.042 |
| 5,769,438 | A * | 6/1998 | Svetlov | 280/87.041 |
| 5,855,385 | A * | 1/1999 | Hambsch | 280/87.042 |
| 5,927,734 | A * | 7/1999 | Horton et al. | 280/87.042 |
| 6,293,571 | B1 * | 9/2001 | Wen | 280/87.042 |
| 6,375,204 | B1 * | 4/2002 | Tu | 280/87.042 |
| 6,419,248 | B1 * | 7/2002 | Kay | 280/87.042 |
| 6,460,868 | B2 * | 10/2002 | Madrid | 280/87.042 |
| 6,631,913 | B2 * | 10/2003 | Godfrey | 280/87.05 |
| 6,648,363 | B2 * | 11/2003 | Gordon | 280/610 |

FOREIGN PATENT DOCUMENTS

| | | |
|---|---|---|
| DE | 196 34 596 | 10/1997 |
| WO | WO 98 46316 | 10/1998 |
| WO | WO 0027489 | 5/2000 |

* cited by examiner

*Primary Examiner*—J. Allen Shriver
(74) *Attorney, Agent, or Firm*—Young & Thompson

(57) ABSTRACT

The invention concerns an underframe with controlled deformation for a gliding craft, in particular for a skateboard, characterised in that it comprises a structure with a central platform (12), a front platform (14) and a rear platform (16), the platforms comprising a box-type arrangement with a pressure surface (12-1, 14-1 and 16-1) and a suction surface (12-2, 14-2 and 16-2).

11 Claims, 2 Drawing Sheets

UNDERFRAME WITH CONTROLLED DEFORMATION FOR GLIDING CRAFT, IN PARTICULAR FOR SKATEBOARD

CROSS REFERENCE OF THE RELATED APPLICATION

This is the 35 USC 371 national stage of International Application PCT/FR02/01461, filed on Apr. 26, 2002, which designated the United States of America.

FIELD OF THE INVENTION

The present invention relates to a chassis with controlled deformation for a gliding device, particularly for a skateboard.

BACKGROUND OF THE INVENTION

A skateboard is basically constituted by a platform also called a board, having a given flexibility and two shafts provided at their ends with wheels mounted freely in rotation, said wheels carrying solid tires generally of elastomer, of a quality suitable for the desired maneuvers.

The shafts are each secured to a support carried by a block of elastomer material. This block has the ability to deform particularly proportional to the stiffness of the elastomer and this capacity of deformation permits orientations of the shaft relative to the longitudinal axis of the board.

The user, by his position on the board, can throw his weight to the side, to one side or the other, so as to obtain the desired deformation of the block and the desired orientation of the axles of the wheels. The skateboard can thus be piloted by the position of the user. Nevertheless, the angle of orientation remains small and the turning radius is large.

Such a vehicle remains difficultly controllable particularly when the board is of a great length called a "long board", however it would be useful to be able to make sharper curves.

In the particular case of a device with pneumatic tires and if desired driven, French patent application No. 2 784 302 discloses an arrangement with a deformable parallelogram which accentuates the turning effect and above all permits inclination of the wheels. Such an arrangement, in addition to being mechanically complicated, is incompatible with a skateboard having low clearance as is necessary to facilitate climbing and to ensure perfect balance by keeping the center of gravity as low as possible. Moreover, the control of the deformation of the parallelogram remains a problem not solved by this patent application.

This deformable parallelogram mounting must be reserved for large sized devices, with a high clearance and pneumatic tires.

U.S. Pat. No. 5,540,455 provides an improvement to greatly increase the steering capability. Thus, this patent proposes a platform with two platforms articulated to each other. The user then places one foot on each platform and can orient each as desired. A spring is interposed to constitute this articulation.

This permits increasing the number of combinations of orientations of the shafts, but it will also be seen that steering such a structure is sensitive because the orientations of the two shafts can be opposed, which gives rise to extreme or even dangerous movements. Moreover, the two portions can be inclined in the longitudinal direction also forming a V with the axis of movement, which is not satisfactory.

European patent application No. 0 933 103 discloses an arrangement with oscillating arms mounted on a pivotal platform. If such an arrangement can give rise to certain comfort relative to the surface on which the skateboard moves, it does not solve the problem of turning whilst having perfect control of this turning. Moreover, the complexity of such an arrangement makes it incompatible with market conditions or limits it to the elite.

SUMMARY OF THE INVENTION

The present invention provides a chassis with controlled deformation for a gliding device, particularly for a skateboard which is controllable as to steering, which is sensitive to the distribution of the weight transversely but also longitudinally, which is of an embodiment compatible with industrial production, which is of simplified handling and total reliability because it involves structural elements and not connected mechanical movable elements.

According to another object, the chassis with controlled deformation of the invention improves the turning by rendering it particularly more progressive.

According to another object, the chassis with controlled deformation of the invention can be adapted and adjusted as a function of the user by several simple modifications.

BRIEF DESCRIPTION OF THE DRAWINGS

The invention will now be described in detail with respect to the accompanying drawings, which show a particular and preferred embodiment but are not limiting, the different figures showing.

DETAILED DESCRIPTION OF THE INVENTION

Figure 1A:
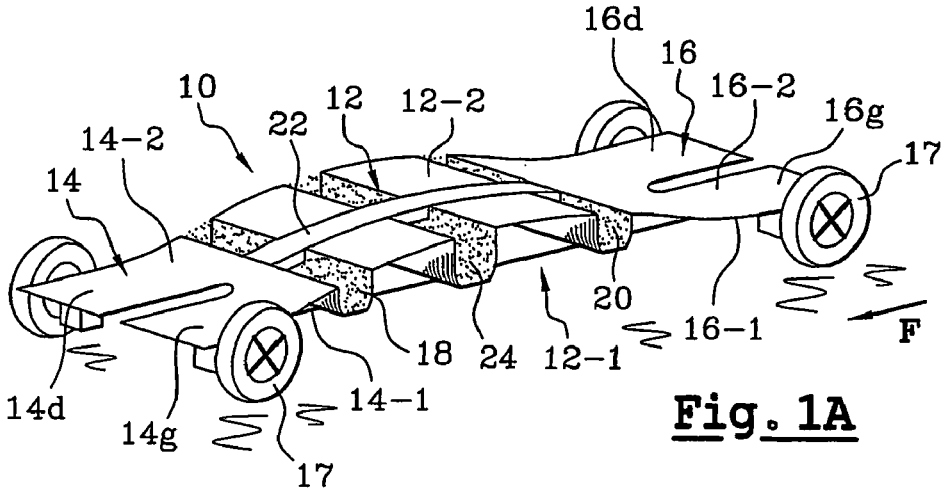
FIGS. 1A and 1B, a schematic perspective view from above of the chassis according to a preferred embodiment of the present invention, with independent arms, FIG. 2 a longitudinal cross-sectional view of the chassis of FIG. 1, FIG. 3, a transverse cross-sectional view on the line 3—3 of FIG. 2, FIG. 4, a top plan view showing the deformation arising from a force exerted by the user on the right side relative to the direction of advance, and in a front/rear centered position FIG. 5, a top plan view showing the deformation arising from a force exerted by the user on the right side relative to the direction of advance, and in a longitudinally off-centered position toward the front, FIG. 6, a schematic side elevational view permitting showing the taking up of the load.
Figure 1B:
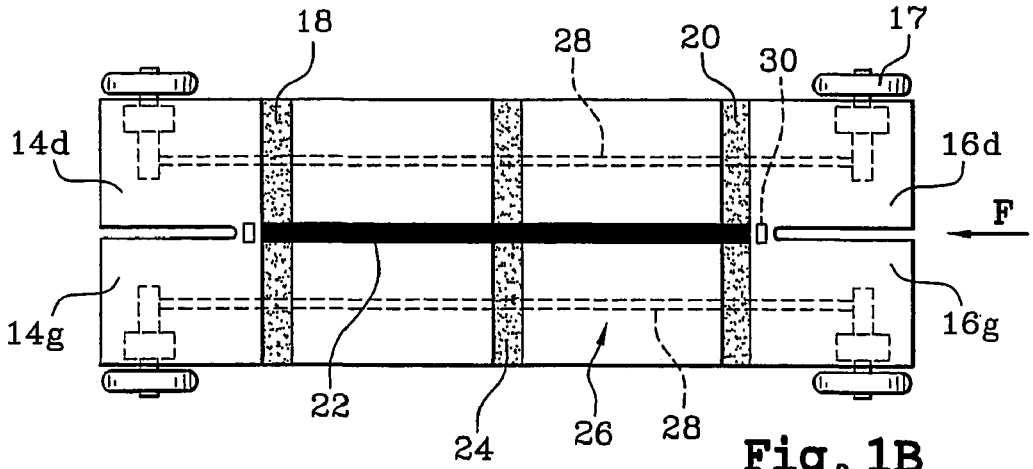
Figure 2:
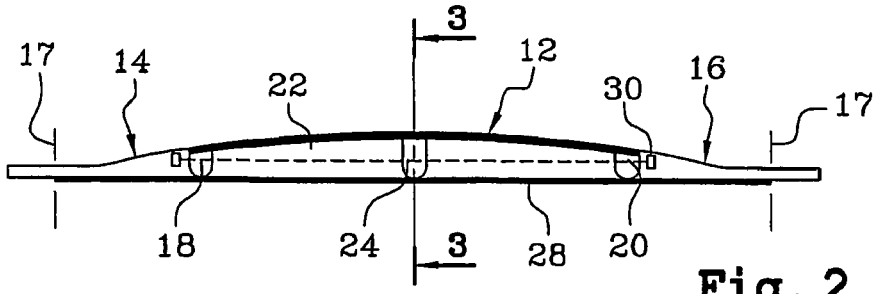
Figure 3:
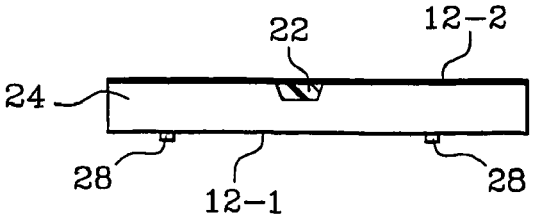

The present invention will now be described as to its structure with respect to FIGS. 1 to 3.

The chassis comprises a structure 10 with a central platform 12, a front platform 14 and a rear platform 16, both secured to the central platform. These platforms comprise as a casing an intrados 12-1, 14-1 and 16-1 and an extrados 12-2, 142 and 162.

The terms intrados and extrados relate in the present application to a structure subjected to mechanical stresses, by analogy to a bridge, the extrados corresponding to the upper portion working in compression and the intrados to the lower part working in tension. Of course the upper surface can have a concave profile, not shown in the drawings.

In this preferred embodiment, each front and rear platform is comprised by two independent arms 14*g,* 14*d;* 16*g,* 16*d* each carrying a wheel 17 or skid, freely mounted in rotation on a shaft.

Each of the front and rear platforms is secured to the central platform 12, in this case by a transverse crosspiece 18 and 20, of U shaped profile, made of a composite material so as to give to the wings of each U shaped profile resilient return properties in the two directions and to form an articulation. These crosspieces ensure the spacing between the extrados and the intrados.

These U shaped profiles are simpler and more widely used, easily available on the mark but any other W or double U shape or else with variable dimensions both transversely and longitudinally, are immediately applicable, as a function of the uses, such a choice being within the scope of those skilled in the art. The essential function of these elements forming crosspieces is to permit a deformation of the chassis, particularly a flexural movement in the horizontal plane.

These profiles have their base in the plane of the intrados. Moreover, one of the wings of each profile is secured to the extrados of the front or rear platform and the other is secured to the extrados of the central portion. These U shaped profiles thus work in flexure, in compression and in tension, according to the movements.

One of the most important and essential elements of the invention is a longitudinal column 22, preferably in the medial position for reasons of symmetry. This column is disposed in the central platform and has a high stiffness. This column is deformable in the horizontal and/or vertical plane and is connected to the two front and rear platforms. In this embodiment, this column connects the U shaped crosspieces, parallel to the extrados 12-2 of the central portion. This column works in flexure and/or in compression. It ensures a resilient return in the face of deformations arising from the movements of the user.

This central platform is provided with at least one transverse crosspiece 24, identical to the crosspieces 18 and 20, with similar dimensioning as will be explained later. This crosspiece also ensures the spacing between the extrados and the intrados. This crosspiece is shown in the medial position in this embodiment but it could be off-centered according to the desired effects.

Thus the extrados 12-2 of the central portion is also provided in two parts each connected to one of the wings of the U shaped profile whilst the base is connected to the intrados 12-1.

Thus the two front and rear platforms are articulated relative to the central portion and this central portion itself comprises a medial articulation.

There are also provided means 26 for taking up the vertical load, which constitute the intrados. These means comprise at least one tendon, in this case two longitudinal tendons 28, both connected to the front and rear platforms and operating in traction and passing below the central platform.

Thus, for any load exerted on the extrados, the tendons work in traction and the longitudinal medial column 22, in addition to working in flexure and ensuring resilient return in the horizontal plane, works also in compression by taking part in assuming the loads.

Figure 4:
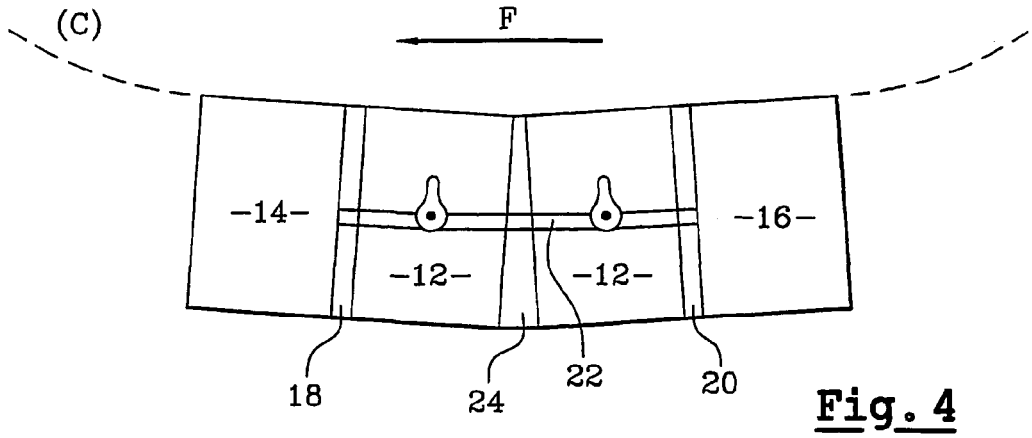

As shown in FIG. 4, the user exerts a force on the right side relative to the direction F of advance. The two sets of wheels are oriented symmetrically along the curve C because the user is in centered front/rear position. The transverse medial crosspiece 24 and the longitudinal medial column 22 operate principally.

Figure 5:
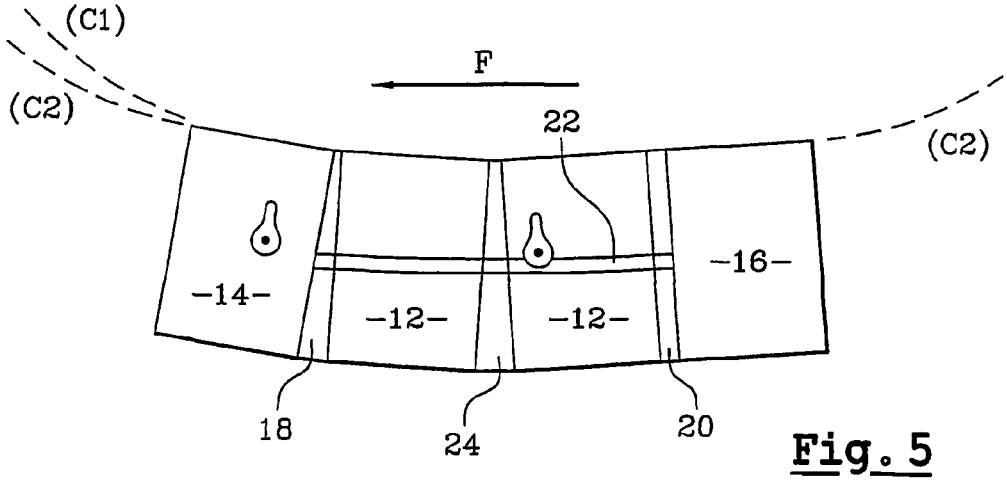

In FIG. 5, the user exerts his force again on the right side relative to the direction of advance, but in a longitudinally off-centered position toward the front. It will be seen that there is a more pronounced deformation to the front according to a curve C1 which leads to a sharper curvature whilst the rear follows a curve C2 with a larger turning radius.

Thus, in this case, the transverse medial crosspiece 24 and the longitudinal medial column 22 are urged principally but moreover the front crosspiece 18 is deformed. Thus the front train turns with a turning angle which is the sum of the two deformations, which will give a more pronounced curvature.

In these FIGS. 4 and 5, there will be seen the deformation of the different crosspieces whose wings move toward each other to ensure an angular deformation.

During these differential turning movements, there is produced a booster effect because the bearing pressure of the user, in addition to the centrifugal force, gives rise to a driving action.

It will also be noted that in this arrangement according to the present invention, the chassis is particularly stable no matter what the speed. Thus, this double deformation is not subjected to the effects of speed and no effect of instability is noted at high speed.

In the mounting of a hub on an elastomeric block, either the adjustment is hard and the device is more stable at high speed but less maneuverable, or else the adjustment is flexible for easy handling and the device quickly becomes unstable as soon as the speed increases.

For the device of the present invention, the resilient return force of the wings of the crosspieces can be adjusted because the U shape permits introducing a quantity of elastomeric foam for example. The density of this elastomeric foam and its internal structure with open cells or closed cells permits fine adjustment as a function of the weight of the user in particular.

As a modification, there can also be provided other resilient return elements such as springs or flexible blades.

It is also possible to provide means 30 for restraining the column, which is adjustable, so as to harden more or less the reactivity of this column. Thus such means can comprise an embedded table with a system of stretchers.

Figure 6:
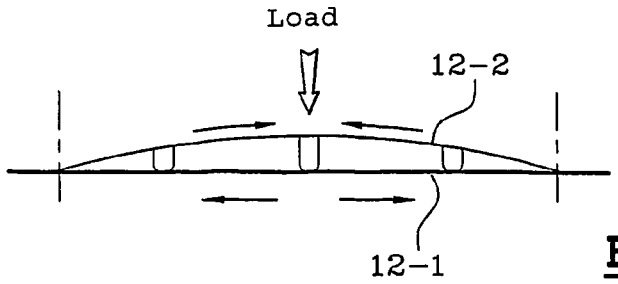

Similarly, in FIG. 6, it will be seen that the assumption of the weight of the user is effected by tendons whose resilient return capacity also permits an adjustment of the flexibility under load, constituted by the weight of the user and the dynamic forces.

When the user is disposed on only one side, the lateral dis-equilibrium gives rise to turning the greater the force approaches the middle of the board. Thus the user can control the manipulability and the stability of the chassis by moving the load.

The described embodiments have been simplified with crosspieces of a small number but, as a function of needs and calculations, it is also possible to multiply these crosspieces so as to effect a vertebral column of the wishbone type.

It is important to note that the chassis with controlled deformation, of the invention, comprises a front and a rear portion connected by means of a central portion, the assembly forming a casing structure with a moment of inertia in the longitudinal vertical medial plane that is relatively high, so as to take up particularly the force exerted by the weight of the user, said structure offering lesser resistance to permit deformations by flexure in the horizontal plane. This arrangement permits, during movement of the load, giving rise to a deformation of the structure permitting steering, as shown for example in FIGS. 4 and 5.

By way of example, the central portion can be made of a block of expansible material, of foam for example, with non-uniform properties so as to obtain the casing structure described above.

According to another embodiment, the central portion can comprise a rigid board connected respectively to the front and rear portion by an element, particularly a column disposed in the medial longitudinal plane, so as to obtain the casing structure described above.

According to another embodiment, the central portion can comprise two boards connected rigidly one to the front portion and the other to the rear portion, the two boards being interconnected by an element, particularly a column disposed in the longitudinal medial plane, so as to obtain the casing structure described above.

According to another embodiment, the central portion can comprise a casing shape with crossed stiffening elements disposed at the level of diagonals, so as to obtain the casing structure described above.

For all the modifications, the presence of at least one longitudinal tendon, operating in traction, connecting the front and rear portions, disposed at the level of the intrados, is necessary.

In the arrangements which result from the principal embodiment, can be cited a skateboard with three wheels instead of four, because this will suffice for stability and the benefits of the structure described above are preserved.

It will be noted that in the device described above, the wheels, mounted on oscillating arms, permit emplacing at least one braking element or at least one element for slowing the set of wheels. The greater diameter permits envisaging industrial production by resorting to approved and simple techniques and hence for a low production cost, by adapting for example techniques for the production of wheels for bicycles or carts.

What is claimed is:

1. Chassis with controlled deformation for a gliding device, the chassis comprising:

a structure having a central platform, a front part, and a rear part;

each front part and rear part comprising two independent arms;

each arm carrying a wheel mounted freely in rotation on a shaft; and the structure comprising a casing arrangement having an upper portion, which in use works in compression, and a lower portion, which in use works in tension.

2. The chassis with controlled deformation for a gliding device according to claim 1, wherein the central platform comprises at least one element deformable in the horizontal and/or vertical plane, acting in flexure and/or compression.

3. The chassis with controlled deformation for a gliding device according to claim 1, further comprising means for assuming the vertical load forming the lower portion of the casing.

4. The chassis with controlled deformation for a gliding device according to claim 3, wherein the means for assuming the vertical load comprise at least one longitudinal tendon operating in tension, disposed between the front and rear parts, and passing below the central platform.

5. The chassis with controlled deformation for a gliding device according to claim 1, wherein each of the front and rear parts is connected to the central platform by at least one longitudinal medial column.

6. The chassis with controlled deformation for a gliding device according to claim 5, wherein each of the front and rear parts is connected to the central platform by a transverse crosspiece permitting deformations of the chassis by flexure in the horizontal plane.

7. The chassis with controlled deformation for a gliding device according to claim 6, wherein each transverse crosspiece is disposed between the upper portion of the casing and the lower portion of the casing so as to ensure their spacing.

8. The chassis with controlled deformation for a gliding device according to claim 6, wherein each profile of each transverse crosspiece has its base bearing on the lower portion of the casing, and a portion of each profile is secured to the upper portion of the front or rear parts, and another portion is secured to the upper portion of the central platform, so as to cause the profiles to act in flexure.

9. The chassis with controlled deformation for a gliding device according to claim 6, wherein each transverse crosspiece is a U shaped profile.

10. The chassis with controlled deformation for a gliding device according to claim 9, wherein the upper portion of the central platform is made in two parts, each connected to one of the wings of the U shaped profile of the crosspiece, while the base of the U shaped profile is connected to the lower portion of the casing.

11. The chassis with controlled deformation for a gliding device according to claim 1, wherein the central platform is provided with at least one transverse crosspiece.

* * * * *